US005668920A

United States Patent [19]

Pelonis

[11] Patent Number: 5,668,920

[45] Date of Patent: Sep. 16, 1997

[54] CEILING FAN WITH ATTACHABLE HEATER HOUSING HAVING AN ADDITIONAL FAN THEREIN

[75] Inventor: Kosta L. Pelonis, Taipei, Taiwan

[73] Assignee: Pelonis USA Ltd., Malvern, Pa.

[21] Appl. No.: 587,378

[22] Filed: Jan. 17, 1996

[51] Int. Cl.[6] ..... F24H 3/02

[52] U.S. Cl. ..... 392/361; 392/364; 416/5

[58] Field of Search ..... 392/364–367, 392/361; 416/5, 95; 165/122, 125

[56] References Cited

U.S. PATENT DOCUMENTS

| | | | |
|---|---|---|---|
| 1,798,290 | 3/1931 | Winner et al. | 392/367 |
| 2,044,832 | 6/1936 | Child | 392/364 |
| 2,267,425 | 12/1941 | Rowe et al. | 392/364 |
| 3,176,117 | 3/1965 | Knoll et al. | 392/364 |
| 3,223,828 | 12/1965 | Mast | 392/364 |
| 4,034,204 | 7/1977 | Windsor et al. | 392/367 |
| 4,146,776 | 3/1979 | Johanson . | |
| 4,504,191 | 3/1985 | Brown | 416/5 |
| 4,508,958 | 4/1985 | Kan et al. . | |
| 4,526,227 | 7/1985 | Baker . | |
| 4,560,909 | 12/1985 | Peil . | |
| 4,681,024 | 7/1987 | Ivey . | |
| 4,694,142 | 9/1987 | Glucksman . | |
| 4,782,213 | 11/1988 | Teal | 392/362 |
| 5,077,825 | 12/1991 | Monrose . | |
| 5,245,692 | 9/1993 | Kawai | 392/364 |
| 5,333,235 | 7/1994 | Ryder . | |
| 5,425,126 | 6/1995 | Lee . | |

FOREIGN PATENT DOCUMENTS

| | | | |
|---|---|---|---|
| 828757 | 1/1952 | Germany . | |
| 5-272810 | 10/1993 | Japan | 392/361 |
| 873047 | 7/1961 | United Kingdom | 392/361 |

*Primary Examiner*—Tu B. Hoang
*Attorney, Agent, or Firm*—Paul & Paul

[57] ABSTRACT

A dual fan room heater includes a conventional ceiling fan and a heating assembly unobtrusively mounted below the ceiling fan and having a PTC heating element and second fan for circulating air over the heating element. The dual fan provides heat in an efficient, effective and comfortable manner.

20 Claims, 7 Drawing Sheets

CEILING FAN WITH ATTACHABLE HEATER HOUSING HAVING AN ADDITIONAL FAN THEREIN

BACKGROUND OF THE INVENTION

1. Field of the Invention

The present invention relates to ceiling fans and more particularly ceiling fans including heaters and heater attachments for ceiling fans.

2. Brief Description of the Prior Art

Ceiling fans are well known as effective means for circulating air in enclosed spaces. They are employed chiefly in warm weather conditions for cooling and ventilating rooms. The fans, which are typically centered in the ceiling of a room, employ relatively large blades (for example, about one half meter in length) circulating at low speeds (for example, about 130 rpm), and are typically operated to push air downward in the center of the room, the air returning to the fan proximate the walls and ceiling of the room. Because ceiling fans are typically operated at low speeds, they operate quietly, which is very desirable for the room's occupants.

While ceiling fans are used almost exclusively under warm conditions, they are also of potential value in cool and cold weather, when enclosed spaces must be heated. Since hot air rises, rooms tend to be heated from the top down, lengthening the discomfort endured by their occupants from the cold, particularly when ceilings are high. This is also wasteful of energy, because the upper portion of a room is not occupied. Because they tend to bring air close to the ceiling of a room down towards the center of the room, ceiling fans can increase the comfort of occupants of cold rooms while they are being heated through their circulation of the room's air, and reduce energy costs. On the other hand, the slight draft they create, so pleasant on a sultry day, may have the opposite effect on a cold one.

A number of efforts have been made in the prior art to provide ceiling fans themselves with means for heating the room. One popular direction, exemplified in U.S. Pat. Nos. 4,782,213 and 4,504,191 has been to attempt to fit the fan blades themselves with heating elements. This has the inherent difficulty of requiring moving electrical contacts for the heater circuits, which must carry a relatively large current if they are to effectively heat the room. A further difficulty lies in the proximity of the fan blades to the ceiling, which tends to promote heat loss to the ceiling.

A second approach has been to mount heating elements in the vicinity of the fan blades, so that air to be heated is drawn or pushed over the heating elements. This second approach, which is exemplified in U.S. Pat. Nos. 5,077,825, 5,333,235, and 5,425,126, also inherently suffers from a number of serious drawbacks.

If the heating elements are mounted below the fan blades, such as in U.S. Pat. Nos. 5,077,825 and 5,333,235, aesthetics and consumer acceptance dictate that they be near the fan's rotational axis. However, in this case the ceiling fan motor immediately above them must be provided with substantial thermal protection. Further, the air flow from the rotating blades is minimal proximate the rotational axis, limiting heat transfer from the heating elements to the circulating air. These factors substantially limit the amount of heat that can be safely provided. Conversely, if the heating elements are disposed above the fan blades, such as in U.S. Pat. No. 5,425,126, not only the fan motor, but also the ceiling, must be thermally insulated from the heating elements. In the device shown in the '126 patent the fan is operated backwards, blowing air up over the heating elements. Unless special arrangements are otherwise made, circulating air in this way will wastefully heat the ceiling and walls before the center of the room. Thus, in the '126 device the heated air is pushed through a set of tubes arranged to spill the heated air just outside and below the radial sweep of the ceiling fan blades, so that the heated air is delivered to the center of the room. However, these tubes give the device an unconventional appearance, reducing consumer acceptance.

It is an object of the present invention to overcome the several disadvantages of the prior art, and to provide a ceiling fan room heater which effectively and comfortably heats an enclosed space in cool and cold weather and which can be used in a conventional manner to circulate the air and ventilate the enclosed space in warm and hot weather. An important object of this invention is to provide a ceiling fan room heater which delivers heat quietly. It is a further object of the present invention to provide a heating assembly adapted for mounting on an existing ceiling fan to provide heat in an efficient, effective and comfortable manner. It is also an object of this invention to provide for an existing ceiling fan a heating assembly which can be easily installed on the ceiling fan. Another object of the present invention is to provide a heating assembly for a ceiling fan which is unobtrusive, and which can be matched to the style and finish of the ceiling fan. Yet another object of this invention is to provide a heating assembly for ceiling fans which can be used with lighting accessory kits similar to those conventionally provided for such fans.

SUMMARY OF THE INVENTION

The present invention provides a dual fan room heater which effectively and comfortably heats an enclosed space in cool and cold weather. The dual fan heater includes a ceiling fan assembly comprising a plurality of radially extending fan blades and ceiling fan motor adapted for operation at a low rotational speed to circulate air within a room, and a heating assembly. The dual fan heater can be factory assembled and provided as a unit to the consumer. Alternatively, the heating assembly itself can be provided as an optional accessory for the purchaser of a new ceiling fan or as an add-on for a ceiling fan which had been previously installed. In this case the heating assembly is preferably adapted to be installed as a substitute for a conventional ceiling fan lighting kit.

The heating assembly itself comprises at least one resistive electrical heating element, a heating fan assembly including a plurality of fan blades, and a motor for directing an airstream over the at least one resistive heating element to provide a heated airstream. Preferably, the at least one resistive electrical heating element comprises a PTC-type (positive temperature coefficient) element. The heating assembly further comprises a housing including air inlet means and air outlet means. Preferably, the heating assembly is mounted below the ceiling fan blades, and the heated airstream from the heating assembly is directed downward. The rotating ceiling fan blades themselves also provide a generally downward directed airflow below the blades.

The heating assembly further preferably comprises temperature control means responsive to the ambient temperature. The heating assembly also preferably comprises heating rate control means responsive to a person operating the heater. The heating assembly preferably further include means for directing the flow of the heated airstream into the generally downwardly directed airflow from the rotating ceiling fan blades. Preferably, means for pre-filtering the airstream directed over the at least one resistive heating element are also included. The dual fan room heater can further comprise at least one lighting element.

The present invention also provides a heating assembly adapted for mounting on a ceiling fan to provide a dual fan room heater, the heating assembly comprising at least one resistive electrical heating element, a heating fan assembly including a plurality of fan blades and a motor for directing an airstream over the at least one resistive heating element, and means for mounting the heating fan assembly on the ceiling fan.

The present invention overcomes the various disadvantages of the prior art and advantageously provides a heating assembly adapted for mounting on an existing ceiling fan to quietly provide heat in an efficient, effective and comfortable manner. The heating assembly of the present invention can be easily installed on an existing ceiling fan, and can be used with conventional lighting accessory kits. The heating assembly is unobtrusive, and can be matched to the style and finish of the ceiling fan.

DETAILED DESCRIPTION OF THE PREFERRED EMBODIMENTS

Figure 1:
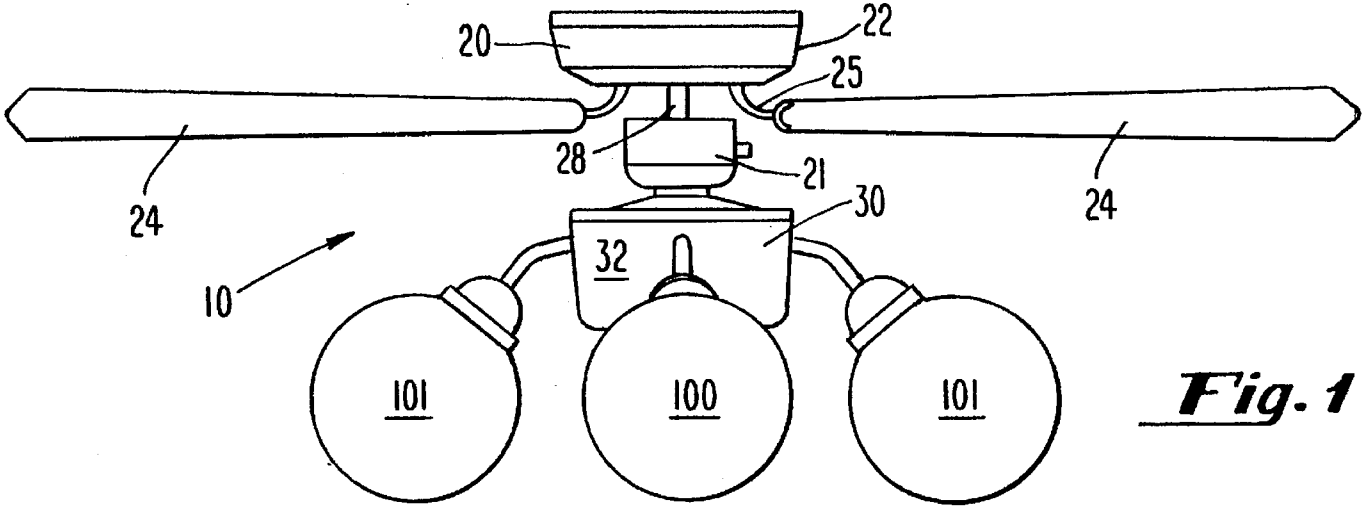
FIG. 1 is an elevational view of a first presently preferred embodiment of a dual fan heater according to the present invention.

Referring now to the drawings, in which like reference numerals identify like elements throughout the several views, there is shown in FIG. 1 an elevational view of a first embodiment of a dual fan room heater 10 according to the present invention.

Figure 2:
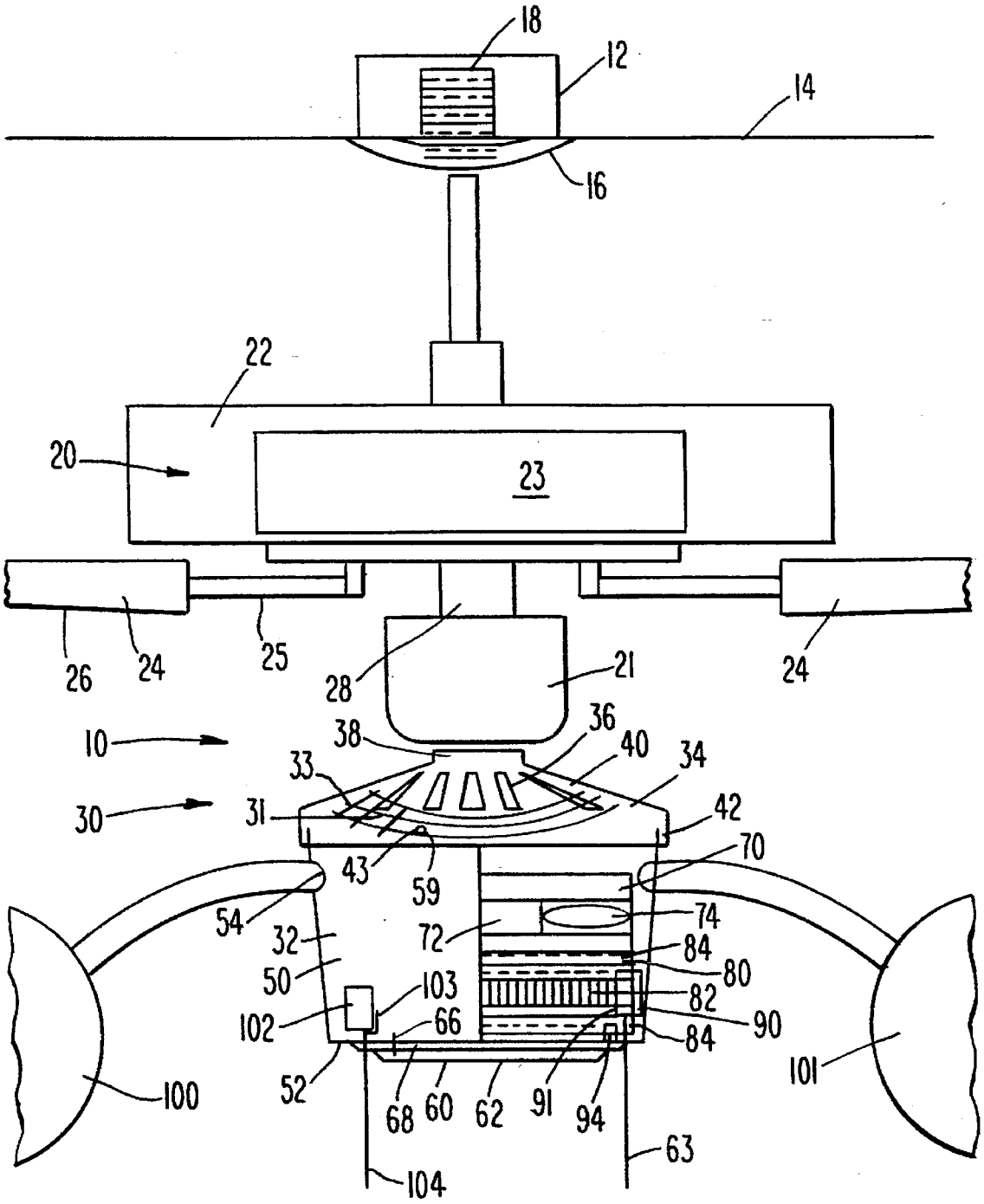
FIG. 2 is a schematic, sectional, elevational view of the dual fan heater of FIG. 1.

As shown in the schematic, sectional, elevational view of FIG. 2, the dual fan room heater 10 is mounted in a conventional manner to an electrical box 12 fixed in the ceiling 14 of an enclosed space to be heated. A pre-existing electrical box 12 positioned near the center of the ceiling 14 for an overhead light can be employed. The box 12 can include box cover 16 to which is affixed a conventional light fixture mounting rod 18, to which the dual fan room heater 10 can be secured.

The dual fan heater 10 includes a ceiling fan assembly 20 and a heating assembly 30. The ceiling fan assembly 20 includes a central motor housing 22 enclosing a conventional low speed electrical motor 23 from which are suspended a plurality, typically four, five or six, of fan blades 24, only two of which are shown in FIGS. 1 and 2 for clarity. Each blade 24 can include a decorative metal stem 25 which is often finished to have a bright or antique metallic appearance matching that imparted to the ceiling fan motor housing 22. Each stem 25 mounts a corresponding wooden paddle 26 to the ceiling fan motor's rotor (not shown).

In one aspect of the present invention, the ceiling fan assembly 20 comprises a pre-existing, previously installed ceiling fan of the type adapted to receive a light kit. In this type of ceiling fan a mounting rod 28 and electrical power connector 29 (FIG. 4) for the light kit are provided by the manufacturer of the ceiling fan. The mounting rod and power connector are often provided by the manufacturer of the ceiling fan inside a small drum shaped housing 21 and concealed by small cover (not shown) in the center of the ceiling fan under the fan blades 24. The cover is easily removed for access to the mounting rod 28 and power connector 29. In this aspect of the present invention, a heating assembly 30 is provided for installation by the consumer or an electrician. In another aspect of the invention, the dual fan heater 10 is provided as a unit completely or at least partially assembled by the manufacturer.

Figure 3:
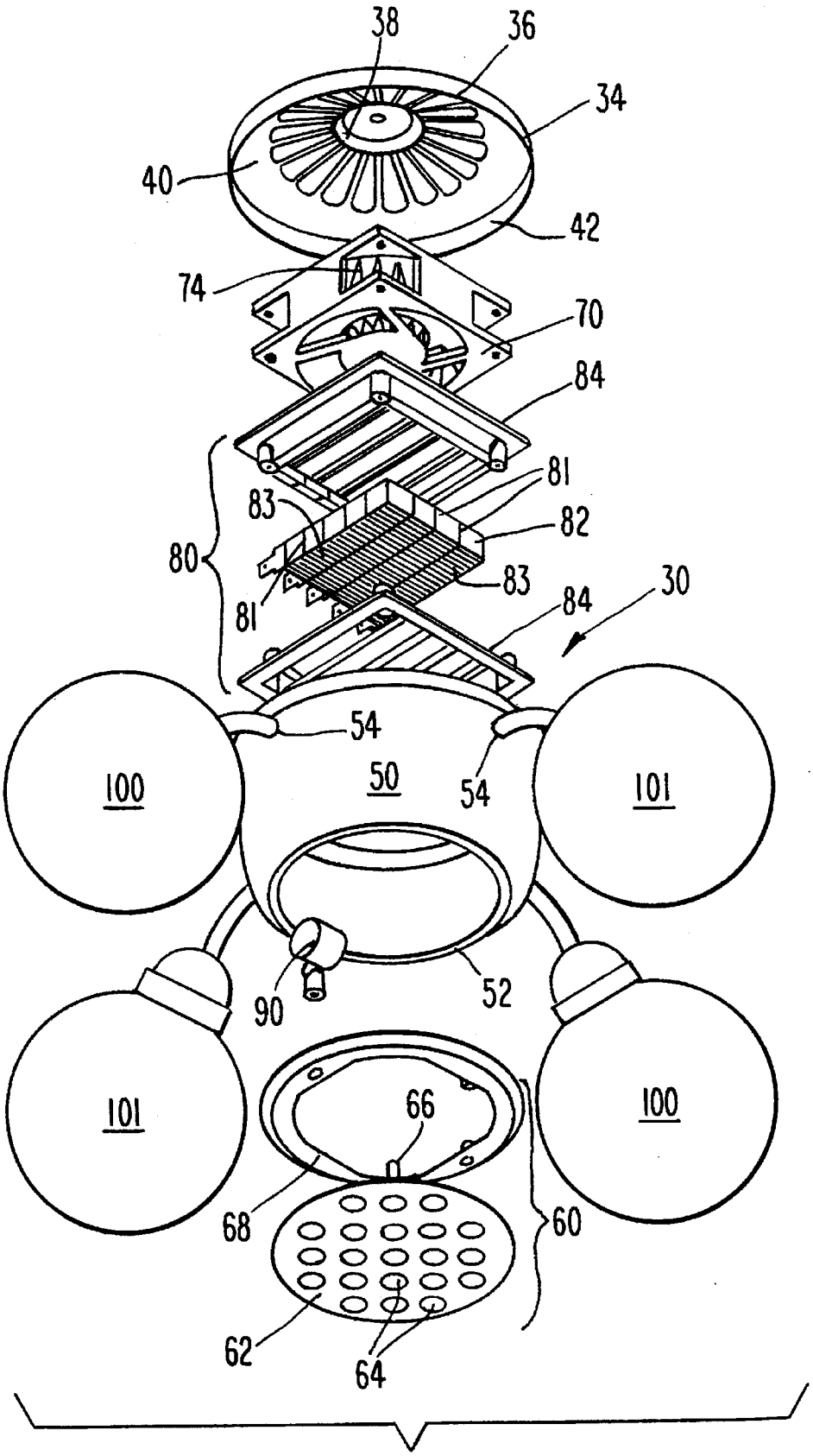
FIG. 3 is an exploded, fragmentary perspective view of the dual fan heater of FIG. 1 as seen from below.
Figure 6:
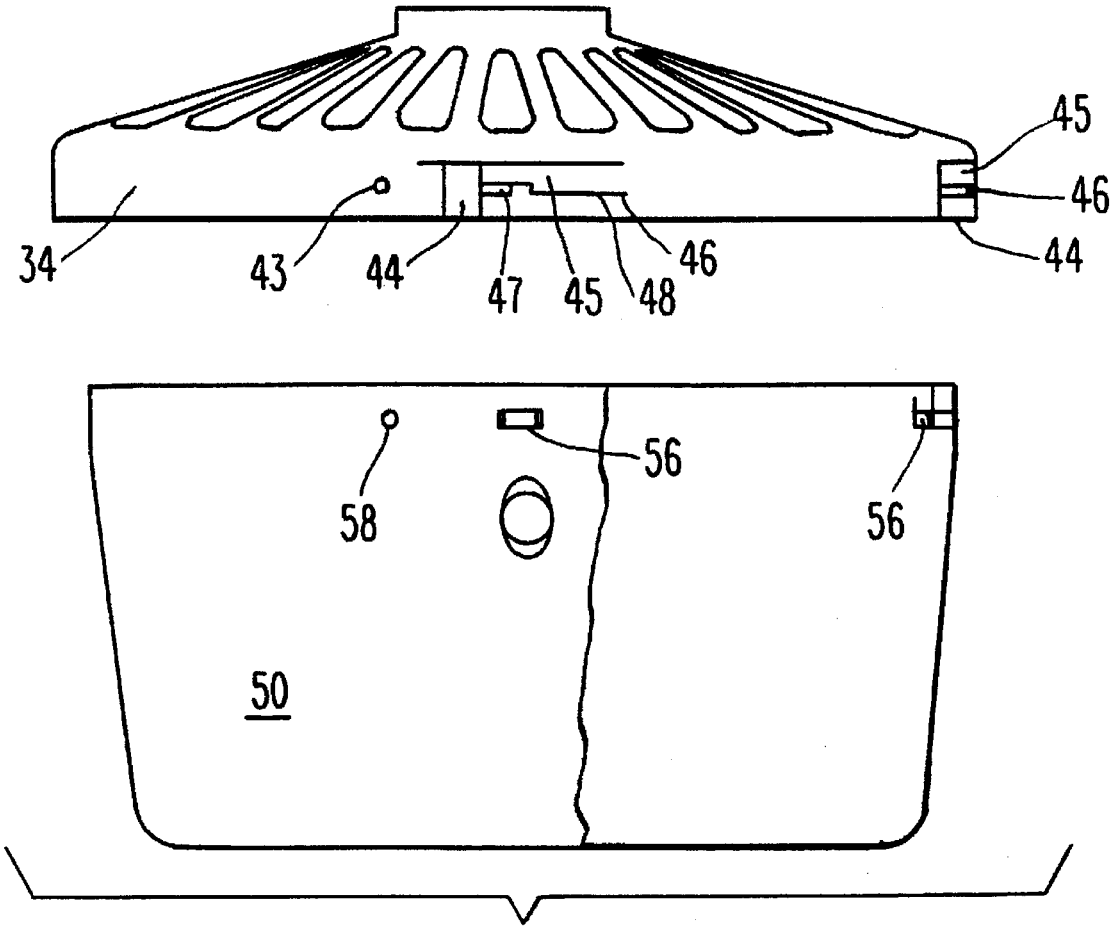
FIG. 6 is a fragmentary elevational view of the body and cover of the heating assembly housing showing the means employed to interlock the body of the heating assembly of FIG. 1 with its cover.

As best seen in FIG. 1 and the exploded, fragmentary perspective view of FIG. 3, the heating assembly 30 includes a generally drum-shaped housing 32 having a central, generally cylindrical body 50 preferably formed from metal and finished to match the ceiling fan motor housing 22 and the decorative stems 25 of the fan blades 24. The body 50 is formed open at the top but inwardly turned at the bottom to form a narrow annular surface or flange 52 for mounting an enclosing air outlet means or outlet section 60. Preferably, as best seen in FIGS. 2 and 6, a set of radially symmetrically disposed, elliptical apertures 54 are formed in the body 50 for mounting an optional set of lamps or lights 100, 101. The housing 32 also includes a generally conical cover 34 in which is formed a plurality of generally trapezoidal air inlet apertures 36 (best seen in FIG. 3) providing an air inlet means or intake for the heating assembly 30. The cover 34 includes a generally cylindrical upper section 38, a central section in the form of a truncated cone 40, and a lower generally cylindrical skirt 42.

As shown in FIG. 2, a removable dust filter 33 rests on top of the cover 34 to filter particulate matter from the airstream entering the heating assembly 30. The dust filter 33 is preferably formed from three identical generally triangular sections 31, each having a pair of sides formed so that the sides of sections can be interlocked to form the dust filter 33. Each section comprises a flexible plastic frame to which is bonded a non-woven or expanded-foam type filter material.

Figure 7:
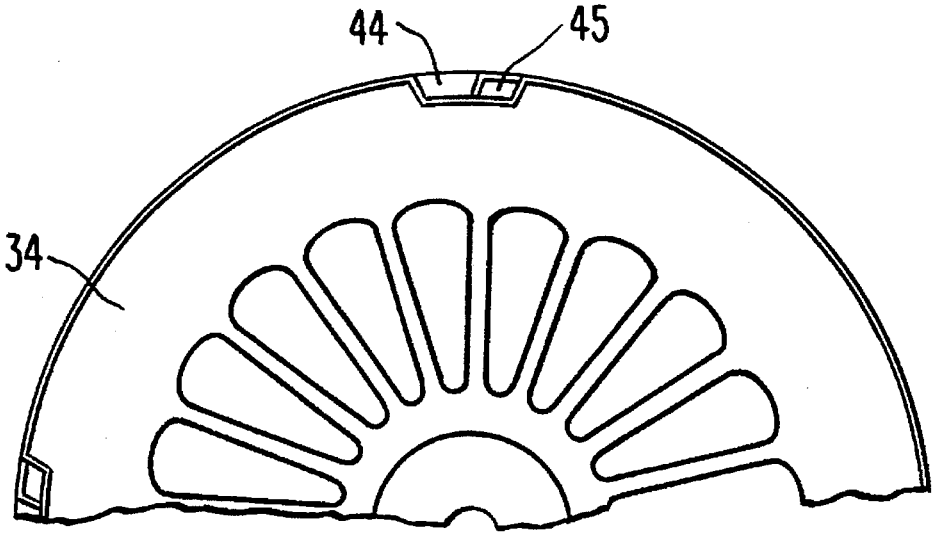
FIG. 7 is a fragmentary plan view of the housing shown in FIG. 6.

As best seen in FIGS. 6 and 7, to facilitate installation of the heating assembly 30 onto the ceiling fan assembly 20, the cover 34 has a plurality of inwardly directed channels 44 for receiving corresponding inwardly directed protrusions 56 formed in the body 50. Each channel 44 has a corresponding notch 45 formed in the cover 34 proximate the upper end of the respective channel 44 and on one side thereof. Each notch 45 has a lower wall 46 having an first section 47 and a second section 48, the lower wall 46 being raised slightly in the first section 47 with respect to the second section. The inside of the skirt 42 of the cover 34 is sized to receive the upper end of the body 50.

When installing the heating assembly 30 the cover 34 is first mounted on the light kit mounting rod 28 and secured with a conventional mounting nut. Electrical connection is then made by plugging a connector 69 (FIG. 4) provided on the heating assembly 30 into the corresponding electrical connector 29 provided by the manufacturer of the ceiling fan for a light kit. At this point the remaining portion of the heating assembly including the body 50 is slid up into the cover 34 with the protrusions 56 formed in the body 50 aligned with the respective channels 44 formed in the cover 34. The body 50 is then rotated so that the protrusions 56 slide into the respective notches 45. The rotation is continued until the protrusions 56 travel laterally in the notches 45 as far as the lateral extension of the notches 45 permit. As the body 50 is rotated, the protrusions 56 travel first over the first sections 47 and then over the second sections 48 of the lower walls 46 of the notches 45. The body 50 is then released by the installer, permitting the lower edges of the protrusions 56 to rest on the lower walls 46 of the notches 45, thus locking the lower portion of the heating assembly including the body 50 to the cover 34. Since the first sections 47 of the lower walls 46 are slightly raised with respect to the second sections 48, accidental rotation of body 50 towards the channels 44 is blocked or hindered.

To insure that the remaining portion of the heating assembly including the body 50 has been fully rotated during installation, a plurality of alignment holes 43 are formed in the lower section or skirt 42 of the cover 34. Each of these holes 43 in the cover 34 become aligned with each of a corresponding plurality of alignment holes 58 formed in the, body 50 proximate the protrusions 56. The installer is at this point directed to screw together the cover 34 and body 50 using at least one set screw 59. This will only be possible if the body 50 has been properly positioned within the cover 34.

As best seen in FIG. 3, the outlet section 60 is comprised of a central metallic screen or grill 62 having a plurality of air outlet apertures 64 and is preferably finished in an unobtrusive color, such as matte black. The screen 62 secured by a plurality of tabs 66 to an annular mounting ring 68 which is preferably formed from a heat-resistant material, such as a heat-resistant thermosetting plastic material. The mounting ring 68 is in turn secured to the flange 52 formed at the bottom of the body 50.

Figure 4:
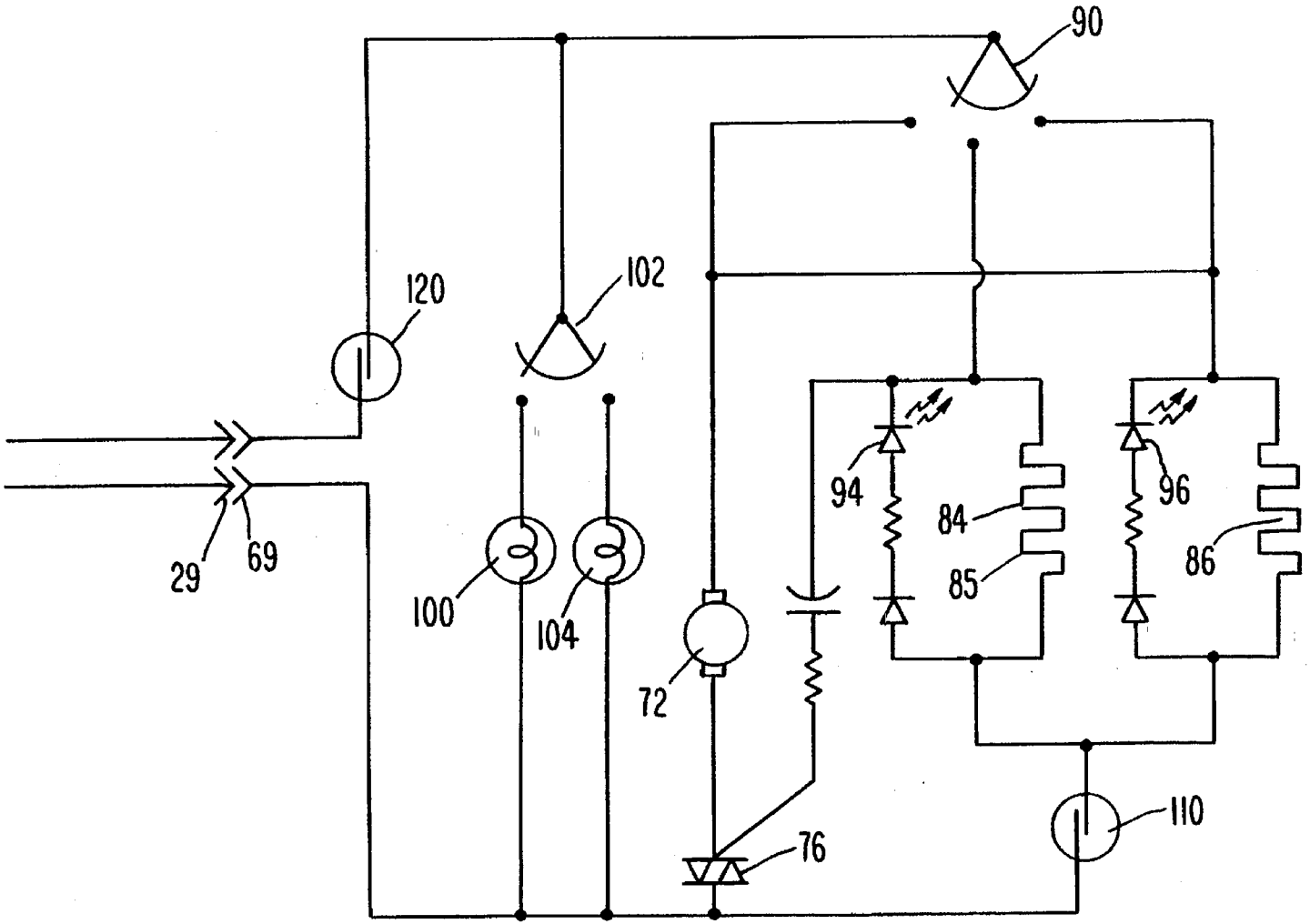
FIG. 4 is an electrical schematic diagram for the dual fan heater of FIG. 1.

The heating assembly 30 also includes a heater fan 70 and a heating section 80 and associated control circuitry (FIG. 4). The heating section 80 is positioned within the housing 32 immediately above the outlet section 60. As shown in FIG. 2, the heater fan 70 includes a fan motor 72 and a plurality of blades 74 and is positioned immediately above the heating section 80. Preferably, the heater fan 70 is a high quality, ball-bearing type fan operated at a relatively low speed, such as about 2500 rpm, to minimize fan noise. The speed of the fan motor 72 is preferably controlled, such as described below, to provide a desired rate of air flow through the heating section 80. The heating section 80 preferably includes at least one PTC-type resistive heating element 82. In a presently preferred embodiment, as shown in FIG. 3, the PTC element 82 comprises a plurality of generally rectangular ceramic semiconducting PTC units 81 (visible in FIG. 3) which are arranged in a set of parallel sheets, with a plurality of heat-dissipating aluminum fins 83 extending between the parallel sheets ("fin-type" element), and the PTC element 82 is positioned between a pair of element holders 84 formed of a temperature resistant plastic material to permit air impelled by the fan 70 to pass easily through the fins 83. Alternatively, other types of PTC elements can be employed, such as the disc-type formed from a solid mass of semi-conductor and having a plurality of air passages formed therein ("disc-type" element). Other types of resistive heating elements could also be used, but are less desirable, in comparison with the PTC-type elements, which are known to have inherently self-limiting temperature characteristics (electrical resistance increases as the temperature increases).

Figure 8:
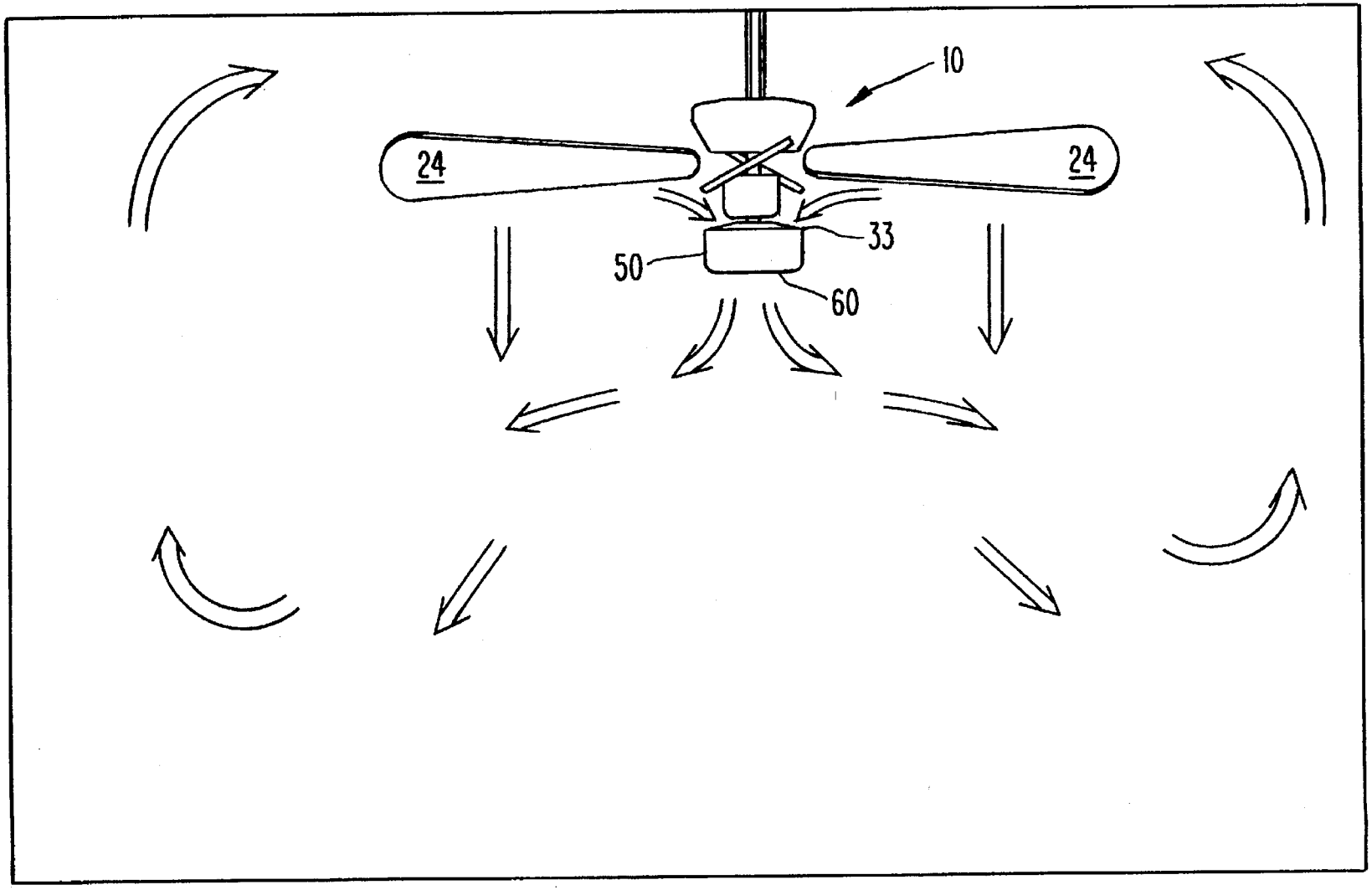
FIG. 8 is a schematic elevational view showing air currents in a room being heated by the dual fan room heater of FIG. 1.

As shown schematically by the arrows in FIG. 8, in operation the heater fan 70 (FIG. 2) inside the heating assembly 30 draws room air down through the dust filter 33 and the air inlet apertures 36 in the cover 34 of the housing 32. The room air is blown over the heat-transferring fins 83 (FIG. 3) of the PTC heating element 82 and out through the outlet section 60 directly downward, thus providing a heated air. Because the air is now warm (for example, about 50 degrees Celsius) it begins to rise (FIG. 8). However, as it does so, it encounters the downwardly directed airstream from the rotating ceiling fan blades 24, with which it mixes. With the dual fan room heater in operation, it has been found that the room temperature distribution is such that the temperature below the heater is significantly greater than that near the room walls.

Figure 9:
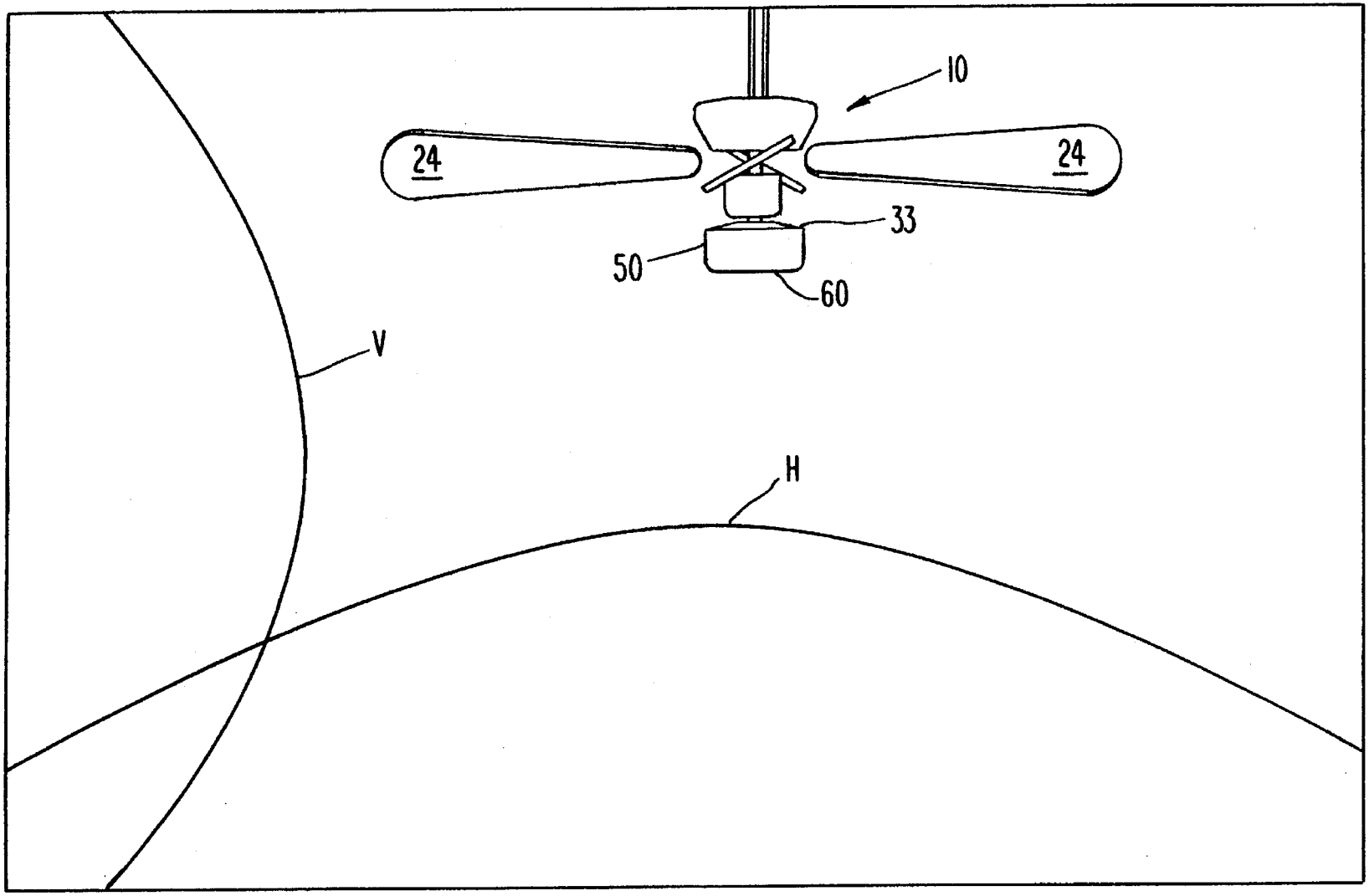
FIG. 9 is a schematic elevational view showing temperature distributions in a room being heated by the dual fan room heater of FIG. 1.

A schematic representation of the ambient temperature distribution in an enclosed space being heated by the dual fan room heater of the present invention is given in FIG. 9. As shown in the schematic representation of the lateral or horizontal temperature distribution H (in which temperature at a fixed height, about 3 feet from the floor, is graphed as a function of distance from the center of the room), the room temperature tends to be at a minimum proximate the walls of the room, thus minimizing heat loss to cold outside walls, and at a maximum towards the center of the room, where the room's occupants are most likely to spend time. Similarly, as shown in the schematic representation of the vertical temperature distribution V (in which temperature in the center of the room is graphed as a function of height), the temperature tends to a maximum towards the middle, where it will be most appreciated by the room's occupants.

Figure 5:
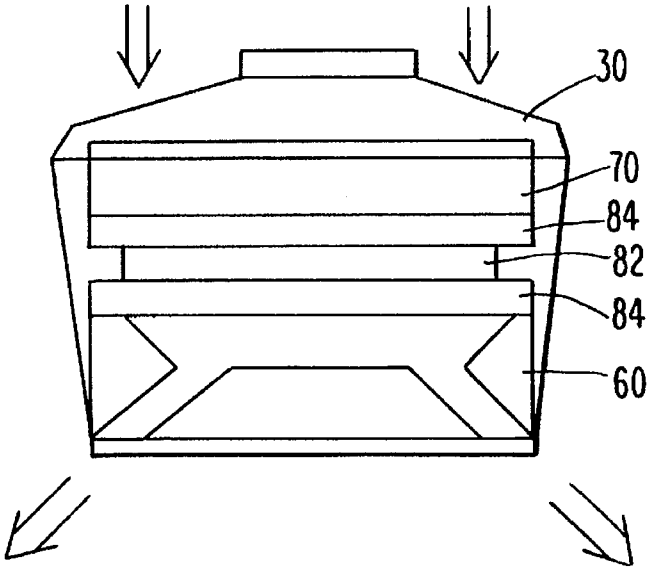
FIG. 5 is a fragmentary, sectional, elevational view of a second embodiment of the present invention.

In a second embodiment of the present invention, shown in the fragmentary sectional elevational view of FIG. 5, the outlet section 60 is modified and provided with a generally conical annular cavity 61, so that the heated air is directed outwardly and downwardly as shown by the arrows towards the airstream downwardly directed by the ceiling fan blades 24. This is presently believed to provide somewhat more rapid heating.

Preferably, as shown in the schematic circuit diagram of FIG. 4, the heating element 82 comprises a first section 85 and a second section 86 connected in parallel through a rotary switch 90 to a power source. The rotary switch 90 is adapted to simultaneously connect two adjacent poles to the power source, and adapted to provide the following sequence: (1) off; (2) half power, (3) full power, (4) half power. The fan 70 is connected to operate continuously whenever power is being supplied to the heating element 82. The fan speed is controlled by a triac 76 such that the fan speed is higher when current is supplied to both the first section 85 and the second section 86 of the heating element 82, than when current is supplied to only one of the two sections. Increasing the fan speed tends to reduce the operating temperature of the outlet section 60 and increase the rate at which heat is transferred from the heating element 82.

Light emitting diodes 94, 96 are mounted in the annular mounting ring 68 of the air outlet section 60 so that they are visible from below the heating assembly 30. One of each of these LEDs 94, 96 is connected in parallel with a respective one of the PTC element sections 85, 86 so that the respective LED is in the "on" state when power is being applied to the respective PTC element section 85, 86. The rotary switch 90 is mounted by a bracket 91 fixed on one side of the element holder 84 and actuated by a control cord or chain 63 which passes through an aperture molded in the annual mounting ring 68 so that the control cord 63 can be operated from below. Thus, the heating rate of the heating assembly 30 can be controlled or varied by the operator through actuation of the rotary switch 90, with the current heating rate being signaled by the LEDs 94, 96. In the alternative, a remote control system for controlling the heating rate can be provided, such as, for example, through a wall-mounted control, or through a remote-controlled infrared type system.

A second rotary switch 102 is provided for controlling the lights 100, 101, with the rotary switch 102 being adapted to simultaneously connect two adjacent poles to the power source to provide the following sequence: (1) off; (2) first lamp pair, (3) first and second lamp pairs, (4) second lamp pair only. The second rotary switch 102 is mounted with a second bracket 103 to the PTC element holder 82 and actuated by a second chain or cord 104, which passes through a second aperture molded in the annular mounting ring 68 to permit the operator to control the lamps 100, 101 from below the heating assembly 30.

The heating assembly 30 is also provided with a temperature limit control 110 of the bimetallic type, although a thermostatic control can be provided in the alternative if desired. In addition, the heating assembly 30 is provided with a safety switch 120 of the type including a small piece of PTC material wired in parallel to a relay-type contacts, one pole of which is bimetallic. If the temperature of the heating assembly 30 exceeds a predetermined limit the contacts open, and a small current then flows through the small PTC element, further warming the bimetallic pole, thus maintaining the contact open until power is purposefully shut off by the operator and the safety switch 120 cools.

Various modifications can be made in the details of the various embodiments of the apparatus of the present invention, all within the scope and spirit of the invention and defined by the appended claims.

I claim:

1. A dual fan room heater comprising:

a) a ceiling fan assembly comprising a plurality of radially extending fan blades and a first fan motor adapted for operation at low rotational speed to circulate air within a room, and b) a heating assembly comprising at least one resistive electrical heating element, an additional heating fan assembly, independent of the ceiling fan, including a plurality of fan blades and a second motor for directing an airstream over the at least one resistive heating element to provide a heated airstream.

2. A dual fan room heater according to claim 1 wherein the at least one resistive electrical heating element comprises a PTC-type element.

3. A dual fan room heater according to claim 1 wherein the heating assembly further comprises a housing including air inlet means and air outlet means, the heating assembly being mounted below the ceiling fan blades.

4. A dual fan room heater according to claim 2 wherein the heating assembly further comprises temperature control means responsive to the ambient temperature to shut off power supplied to said heating element when a limit temperature is achieved.

5. A dual fan room heater according to claim 2 wherein said heating element includes two sections, and said heating assembly further comprises heating rate control means for supplying power to one or both of said sections.

6. A dual fan room heater according to claim 5 wherein the heating assembly comprises a plurality of resistive heating elements and the heating rate control means comprises (a) varying the number of heating elements to which current is supplied and (b) means for controlling the speed of the heating fan.

7. A dual fan room heater according to claim 1 wherein the heated airstream is directed downward from the heating assembly.

8. A dual fan room heater according to claim I wherein the rotating ceiling fan blades provide a generally downward directed airflow below the blades, and further comprising means for directing the flow of the heated airstream into the generally downwardly directed airflow.

9. A dual fan room heater according to claim 2 further comprising means for prefiltering the airstream directed over the at least one resistive heating element.

10. A dual fan room heater according to claim 1 further comprising at least one lighting element.

11. In combination with a ceiling fan having a first motor, a heating assembly adapted for mounting on said ceiling fan to provide a dual fan room heater, the heating assembly comprising at least one resistive electrical heating element, a heating fan assembly including a plurality of fan blades and a second motor for directing an airstream over the at least one resistive heating element to provide a heated airstream, and means for mounting the heating fan assembly on the ceiling fan.

12. A heating assembly according to claim 11 wherein the at least one resistive electrical heating element comprises a PTC-type element.

13. A heating assembly according to claim 11 further comprising a housing including air inlet means and air outlet means, the heating assembly being mounted below the ceiling fan.

14. A heating assembly according to claim 11 wherein the heating assembly further comprises temperature control means responsive to the ambient temperature to shut off power supplied to said heating element when a limit temperature is achieved.

15. A heating assembly according to claim 11 wherein said heating element includes two sections, and said heating assembly further comprises heating rate control means for supplying power to one or both of said sections.

16. A heating assembly according to claim 15 wherein the heating assembly comprises a plurality of resistive heating elements and the heating rate control means comprises (a) varying the number of heating elements to which current is supplied and (b) means for controlling the speed of the heating fan.

17. A heating assembly according to claim 11 wherein the heated airstream is directed downward from the heating assembly.

18. A heating assembly according to claim 11 wherein the ceiling fan has blades which provide a generally downward directed airflow below the blades, and further comprising means for directing the flow of the heated airstream into the generally downwardly directed airflow.

19. A heating assembly according to claim 12 further comprising means for prefiltering the airstream directed over the at least one resistive heating element.

20. A heating assembly according to claim 11 further comprising at least one lighting element.

* * * * *